US006758068B2

(12) United States Patent
Shirasaki et al.

(10) Patent No.: US 6,758,068 B2
(45) Date of Patent: Jul. 6, 2004

(54) THREE-DIMENSIONALLY STRUCTURED WARP KNITTED FABRIC

(75) Inventors: Fumio Shirasaki, Fukui (JP); Yukito Kaneko, Fukui (JP); Kazunori Yamada, Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/966,212

(22) Filed: Sep. 27, 2001

(65) Prior Publication Data

US 2002/0104335 A1 Aug. 8, 2002

(51) Int. Cl.[7] ..... D04B 7/12
(52) U.S. Cl. ..... 66/195; 66/170
(58) Field of Search ..... 66/192, 193, 195, 66/191, 169 R, 170, 190, 196, 202; 442/307, 312, 313, 314, 318

(56) References Cited

U.S. PATENT DOCUMENTS 4,748,078 A * 5/1988 Doi et al. ..... 442/312
5,461,885 A * 10/1995 Yokoyama et al. ..... 602/44
5,896,758 A * 4/1999 Rock et al. ..... 66/191
6,105,401 A * 8/2000 Chadeyron et al. ..... 66/195
6,196,032 B1 * 3/2001 Rock et al. ..... 442/304
6,199,410 B1 * 3/2001 Rock et al. ..... 442/304
6,207,256 B1 * 3/2001 Tashiro ..... 428/116
6,305,875 B1 * 10/2001 Matsumoto ..... 405/16
6,399,523 B1 * 6/2002 Matsumoto ..... 442/1

FOREIGN PATENT DOCUMENTS

JP 62-45760 2/1987

* cited by examiner

*Primary Examiner*—Danny Worrell
(74) *Attorney, Agent, or Firm*—Flynn, Thiel, Boutell & Tanis, P.C.

(57) ABSTRACT

A three-dimensionally structured warp knitted fabric has a higher compressibility and resiliency than its conventionally available counterpart, as well as enhanced abrasion resistance to prevent fuzzing. The three-dimensionally structured warp knitted fabric includes a top substructure and a bottom substructure, either of which is a net texture, the other being a plain texture. Substructure connecting yarns connect the two substructures. A plurality of connecting yarn controlling yarns are present between the two substructures and between the substructure connecting yarns. The connecting yarn controlling yarns control the substructure connecting yarns by handling, separating and holding them. The connecting yarn controlling yarns include portions which are stitched into the plain texture side of the top or bottom substructure and portions which are floating between the top and bottom substructures.

6 Claims, 8 Drawing Sheets

THREE-DIMENSIONALLY STRUCTURED WARP KNITTED FABRIC

BACKGROUND OF THE INVENTION

1. Field of the Invention

The present invention relates to three-dimensionally structured warp knitted fabric for use in the clothing and non-clothing fields as cushioning and filling materials, and more particularly to three-dimensionally structured warp knitted fabric suitable for use as automotive sheet materials. Most particularly, the present invention relates to a three-dimensionally structured warp knitted fabric consisting of top and bottom substructures and yarns connecting these two substructures, which is produced on a double needle bed warp knitting machine so that the top substructure is a net texture with pores and the bottom substructure is a plain texture with no pores to provide it with optimal compressibility, air permeability and resiliency for its application in the above-mentioned fields.

2. Description of the Related Art

Various certain techniques have already been proposed as prior art for producing three-dimensionally structured warp knitted fabric consisting of top and bottom substructures and yarns connecting the two substructures. Such prior art three-dimensionally structured warp knitted fabric is mainly produced on double needle bed warp knitting machines so that the top and bottom substructures are interknitted with the yarns connecting the two substructures at either almost right or oblique angles, or at both angles to provide the fabric with a truss structure. Specifically, the three-dimensionally structured warp knitted fabric produced according to the prior art has focused its design on how to form a truss structure between its top and bottom substructures in order to enhance its compressibility, including how to cause the yarn connecting the two substructures to be intersected with them in order to prevent them from being shifted laterally from each other and what fiber material to use as the substructure connecting yarn.

As described above, the three-dimensionally structured warp knitted fabric conventionally available as prior art is designed focusing on its compressibility with its enhanced resiliency and recovery from compression strongly dependent upon formation of a truss structure between its top and bottom substructures, the use of fiber material of high elasticity as the yarn connecting the two substructures and other factors, especially the use of the substructure connecting yarn with a high density. Due to its above-mentioned structural design, the conventional three-dimensionally structured warp knitted fabric presents such a problem that when subjected to compression, it suffers bending of the high-density substructure connecting yarns, which causes them to be entangled with one another, resulting in extreme deterioration in its resiliency and recovery from the compression.

In addition, the three-dimensionally structured warp knitted fabric according to the prior art, if knitted with a net texture for either or both of its top and bottom substructures, causes a problem of the substructure connecting yarn protruding from the pores in the net texture and thus being subject to external abrasion, which results in trouble such as fuzzing of the yarn. As a result of such trouble, the fabric presents discomfort in use, deterioration in appearance and other problems.

The present invention was worked out in order to solve the above mentioned problems involved in the prior art.

Specifically, it is an object of the present invention to provide a three-dimensionally structured warp knitted fabric which has higher compressibility and resiliency than its conventionally available counterpart, as well as enhanced abrasion resistance to prevent its fuzzing.

BRIEF SUMMARY OF THE INVENTION

To solve the above-mentioned problems associated with the prior art, the inventors of the present invention have discovered that the conventional three-dimensionally structured warp knitted fabric principally consisting of three members—top and bottom substructures and yarns connecting the two substructures—can be modified by having these three members combined with a new additional member "yarns controlling the substructure connecting yarns by handling, separating and holding them" to minimize their bending and consequent entanglement that may otherwise occur when the fabric is subjected to compression, resulting in deterioration in its resiliency and recovery from the compression. The discovery of such substructure connecting yarn controlling yarns has led to the accomplishment of the present invention.

Therefore, the first aspect of the present invention provides a three-dimensionally structured warp knitted fabric consisting of a top substructure and a bottom substructure, either of which is a net texture, the other being a plain texture, and yarns connecting said two substructures with a plurality of yarns present between said two substructures and between said substructure connecting yarns adjacent to each other to control the substructure connecting yarns by handling, separating and holding them, said connecting yarn controlling yarns comprising points at which they are stitched into said plain texture side of the top or bottom substructure and portions where they are floating between the top and bottom substructures.

The second aspect of the present invention provides a three-dimensionally structured warp knitted fabric as specified in the first aspect of the present invention, wherein said substructure connecting yarn controlling yarns are arranged linearly, stitched into the plain substructure at given intervals in the wale direction.

The third aspect of the present invention provides a three-dimensionally structured warp knitted fabric as specified in the first aspect of the present invention, wherein said substructure connecting yarn controlling yarns are arranged in rectangular wave form, stitched into the plain substructure at given intervals in the wale direction.

The fourth aspect of the present invention provides a three-dimensionally structured warp knitted fabric as specified in the first aspect of the present invention, wherein said substructure connecting yarn controlling yarns are arranged in zigzags, stitched into the plain substructure at given intervals with the yarn stitching points as the turn-back of the yarn zigzag arrangement.

The fifth aspect of the present invention provides a three-dimensionally structured warp knitted fabric consisting of top and bottom substructures, either of which is a net texture, the other being a plain texture, with a course-wise cross-section wherein yarns connecting the two substructures have X-shaped intersections with yarns controlling the substructure connecting yarns arranged to hold down the intersections downward.

The sixth aspect of the present invention provides a three-dimensionally structured warp knitted fabric consisting of top and bottom substructures, either of which is a net texture, the other being a plain texture, and yarns connecting the two substructures at right angels to both substructures with yarns arranged floating and winding between the substructure connecting yarns, being stitched into the plain substructure at proper intervals, to control these yarns. The configuration of the three-dimensionally structured warp knitted fabric according to the present invention as described above serves to minimize the bending of the yarns connecting the top and bottom substructures caused when the fabric is subjected to compression, thus preventing deterioration in its resiliency and recovery from the compression due to the entanglement of the substructure connecting yarns resulting from their such bending.

BRIEF DESCRIPTION OF THE DRAWINGS

FIG. 1(A) is a cross-sectional view of a three-dimensionally structured warp knitted fabric according to the prior art with a plain texture for both top and bottom substructures, showing its original state (I) and its compressed state (II), while FIG. 1(B) is a cross-sectional view of a three-dimensionally structured warp knitted fabric according to the prior art with a net texture for either of the top and bottom substructures and a plain texture for the other, showing its original state (I) and its compressed state (II).

FIG. 2(A) is a cross-sectional view of a three-dimensionally structured warp knitted fabric according to the present invention with a plain texture for both top and bottom substructures, showing its original state (I) and its compressed state (II), while FIG. 2(B) is a cross-sectional view of a three-dimensionally structured warp knitted fabric according to the present invention with a net texture for either of the top and bottom substructures and a plain texture for the other, showing its original state (I) and its compressed state (II).

DETAILED DESCRIPTION

Figure 1:
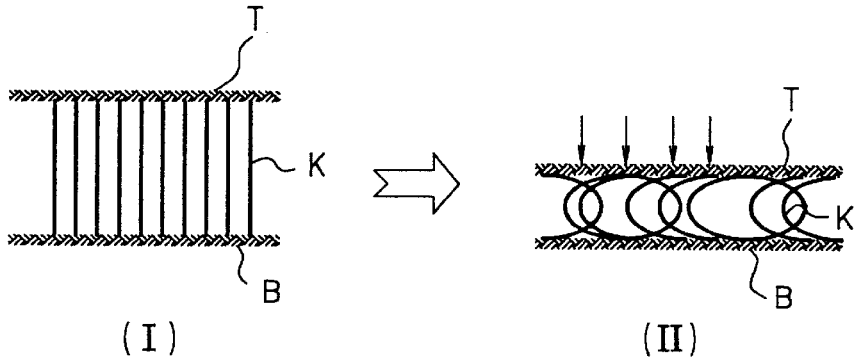
Figure 1:
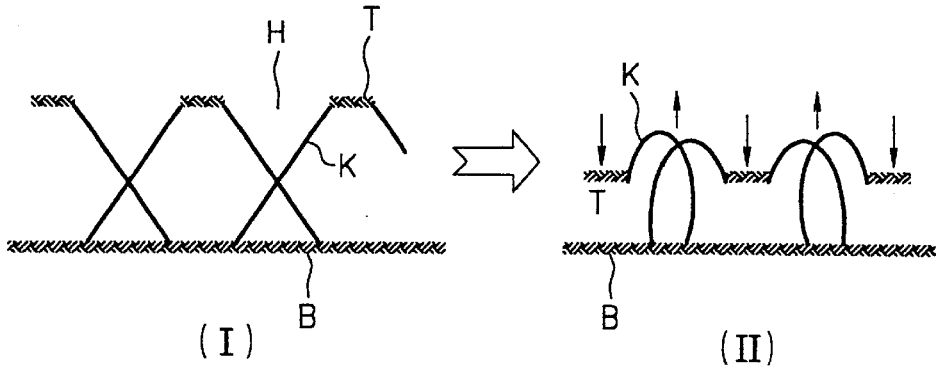

The above-mentioned aspects of the present invention are more specifically illustrated by describing embodiments of the present invention in comparison with those of the prior art. Referring to FIG. 1(A), the prior art three-dimensionally structured warp knitted fabric consisting of top and bottom substructures and yarns connecting the two substructures at right angles as indicated by (I), when subjected to compression, is transformed into the same in its compressed state as indicated by (II), causing the substructure connecting yarns to be bent and entangled with one another with consequent extreme deterioration in its resiliency and recovery from the compression. FIG. 1(B) shows another example of the three-dimensionally structured warp knitted fabric according to the prior art consisting of top and bottom substructures, either of which is a net texture, and yarns connecting the two substructures at oblique angles as indicated by (I), which, when subjected to compression, is transformed into the same in its compressed state as indicated by (II) with resultant protrusion of the substructure connecting yarns from the pores in the net texture, not only causing the yarns to be abraded, but also adversely affecting the appearance of the fabric and its resilience and recovery from the compression.

Figure 2:
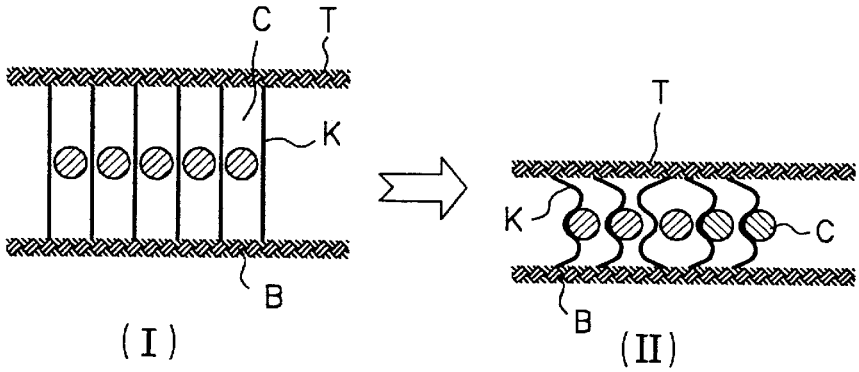
Figure 2:
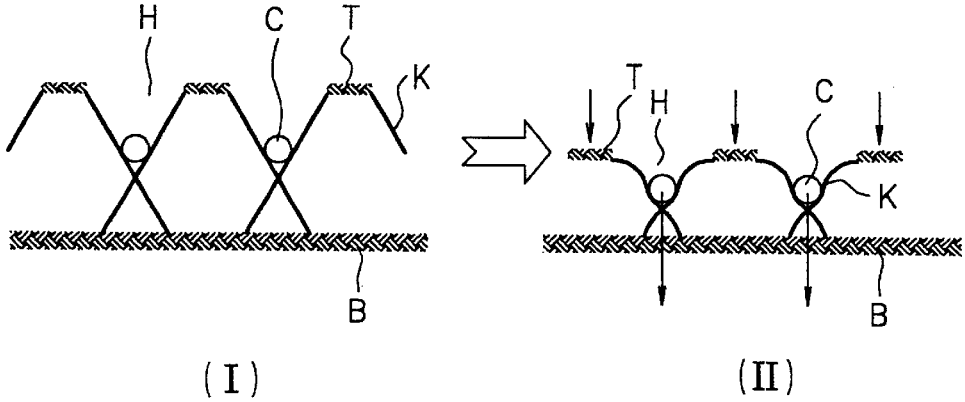

In comparison with the above two examples of the prior art, reference is made to FIG. 2(A), wherein the three-dimensionally structured warp knitted fabric according to the present invention, similarly consisting of top and bottom substructures and yarns connecting the two substructures at right angles, but with yarns present between the substructure connecting yarns to control them as indicated by (I), when subjected to compression, is transformed into the same in its compressed state as indicated by (II) with the bending of the substructure connecting yarns reduced in extent by half due to the presence of the substructure connecting yarn controlling yarns, allowing elimination of their entanglement that may otherwise occur as the cause for deterioration in the fabric's resilience and compressibility. FIG. 2(B) shows another example of the present invention, wherein the three-dimensionally structured warp knitted fabric consisting of top and bottom substructures, either of which is a net texture, and yarns connecting the two substructures at oblique angles with yarns present between the substructure connecting yarns at their intersections to control them as indicated by (I), when subjected to compression, is transformed into the same in its compressed state as indicated by (II) with the intersections of the substructure connecting yarns held down due to the presence of the substructure connecting yarn controlling yarns to prevent their protrusion from the pores in the net texture.

Figure 3:
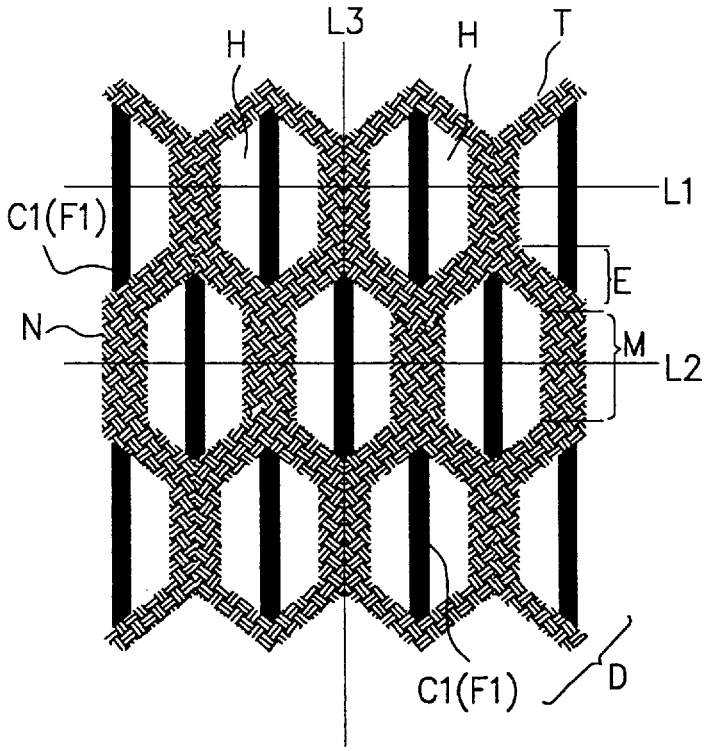
FIG. 3(A) is a top view of a three-dimensionally structured warp knitted fabric according to the first embodiment of the present invention as herein described with a net texture for either of the top and bottom substructures and a plain texture for the other so that the substructure connecting yarn controlling yarns are arranged linearly, FIG. 3(B) L1 and L2 are course-wise cross-sectional views of the fabric taken along lines L1 and L2, respectively, in FIG. 3(A)
FIG. 3(C) is a wale-wise cross-sectional view of the fabric taken along line L3 in FIG. 3(A).
Figure 3:
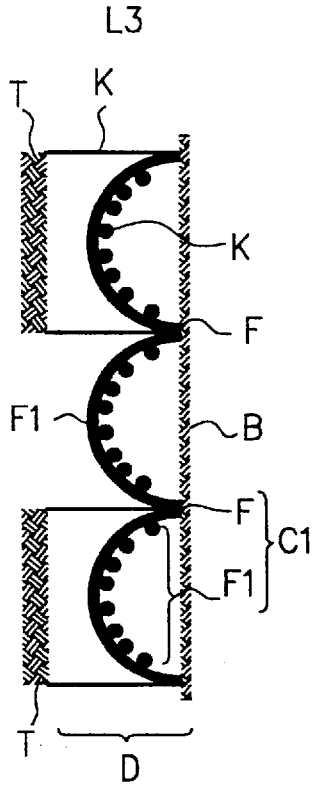
Figure 3:
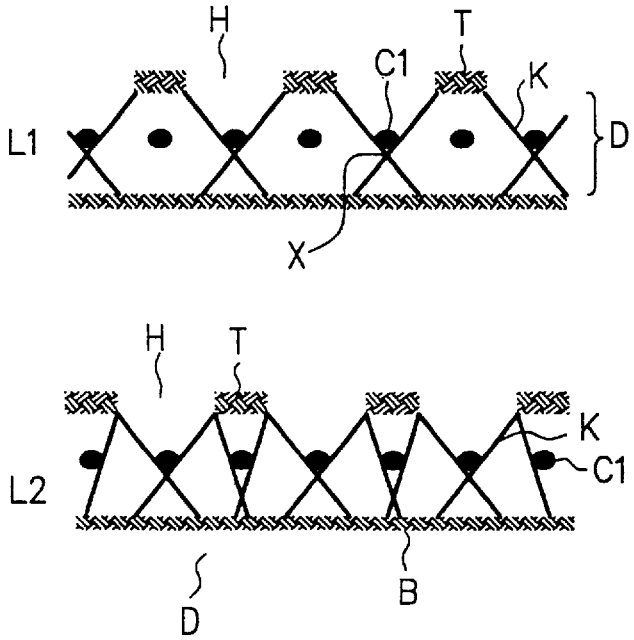

Based on the above description, further detailed illustration of the present invention is given through the following preferred embodiments of the present invention by referring to the accompanying drawings. (First Embodiment of the Invention) In this embodiment of the present invention, as shown in FIG. 3, the three-dimensionally structured warp knitted fabric (D) is designed with a net texture for its top substructure (T) and a plain texture for its bottom substructure (B). As shown in FIG. 3(A), the net texture (N) is composed of hexagonal pores (H), yarn joining portions (M) and yarn branching portions (E). The three-dimensionally structured warp knitted fabric (D) has yarns connecting the top and bottom substructures at oblique angles (K) with X-shaped intersections (X) in its course-wise cross-section as shown in FIG. 3(B).

Figure 4:
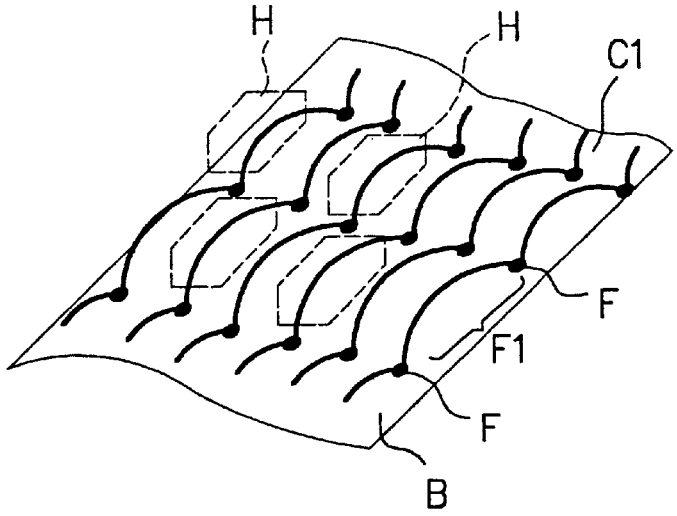
FIG. 4(A) is a fragmentary view of the three-dimensionally structured warp knitted fabric according to the first embodiment of the present invention (as typically depicted in FIG. 3), schematically illustrating how the linearly arranged substructure connecting yarn controlling yarns are arranged and stitched into the plain texture, while floating between the yarn stitched points.
FIG. 4(B) is a fragmentary view of the same fabric, schematically illustrating how the linearly arranged substructure connecting yarn controlling yarns hold down the substructure connecting yarns.
Figure 4:
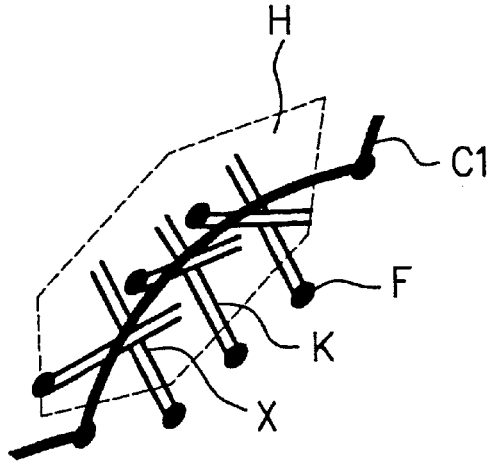

The yarns present between the substructure connecting yarns at their intersections to control them (C) are designed as substructure connecting yarn controlling yarns arranged linearly in the wale-wise direction (C1) as best depicted in FIG. 4(A). The linearly arranged substructure connecting yarn controlling yarns (C1) comprise points at which they are stitched by knitting into the plain-texture bottom substructure at given intervals in a regular manner (F) and portions connecting between the yarn stitched points where they are floating between the top and bottom substructures (F1). As can be seen from FIG. 3(A) and FIG. 4(B), the linearly arranged substructure connecting yarn controlling yarns are arranged in the fabric at a rate of one per pore in the net texture in such a way that they are seen through the pores in the net texture as if to divide each of them into two parts. The yarn stitched points (F) are to be located below the yarn branching portions of the net texture, the location of which prevents them from being exposed in the pores of the net texture.

FIG. 3(B) L1 and L2 schematically depict the course-wise cross-sections of the three-dimensionally structured warp knitted fabric according to the present invention (D) along lines L1 and L2 in FIG. 3(A), respectively. As well understood from this figure, the linearly arranged substructure connecting yarn controlling yarns (C1) positively hold down the intersections (X) of the substructure obliquely connecting yarns (K), while separating them securely. FIG. 3(C) schematically illustrates the wale-wise cross-sections of the three-dimensionally structured warp knitted fabric of the present invention (D) along line L3 in FIG. 3(A). As can be seen from this figure, the linearly arranged substructure connecting yarn controlling yarns (C1) hold the substructure obliquely connecting yarns (K) in the shape of an arch. In the three-dimensionally structured warp knitted fabric configured as described above according to the present invention, the substructure obliquely connecting yarns, whose intersections observed from the pores in the net texture as best depicted in FIG. 4(B) are positively held downward by the linearly arranged substructure connecting yarn controlling yarns, present no problem of protruding from the hexagonal pores even when the fabric is subjected to compression while in use, which may otherwise cause them to be bent, resulting in their protrusion from the pores.

It should be noted here with regard to FIG. 4(B), wherein the substructure connecting yarns are intersected at three points between the yarn stitched points within each of the hexagonal pores, that this number of their intersections is only one example and may vary depending on the construction of the fabric knitted according to the present invention, not being intended to limit such number. In addition, the presence of the linearly arranged substructure connecting yarn controlling yarns in the three-dimensionally structured warp knitted fabric according to the present invention, in addition to its original function referred to in the present invention, can contribute to its enhanced design effects, which are even further increased especially when they are of types having such various properties as luster, perspiration absorption/release and electric conductivity.

The three-dimensionally structured warp knitted fabric of the present invention is preferably manufactured from synthetic fiber, especially polyester fiber. The three-dimensionally structured warp knitted fabric according to the present invention preferably ranges in thickness from 2 to 20 mm. If manufactured with a thickness below the above-specified range, the three-dimensionally structured warp knitted fabric of the present invention may fail to function as cushioning or filling material. Conversely, manufacturing of the three-dimensionally structured warp knitted fabric of the present invention with a thickness exceeding the above-specified range may result in failure of the substructure connecting yarn controlling yarns to perform their function properly as referred to in the present invention. In addition, the three-dimensionally structured warp knitted fabric of the present invention, if manufactured with its top-substructure net texture externally napped, can be further enhanced in its product value, offering a napped three-dimensionally structured warp knitted fabric with high abrasion resistance and soft hand.

(Second Embodiment of the Invention)

Figure 5:
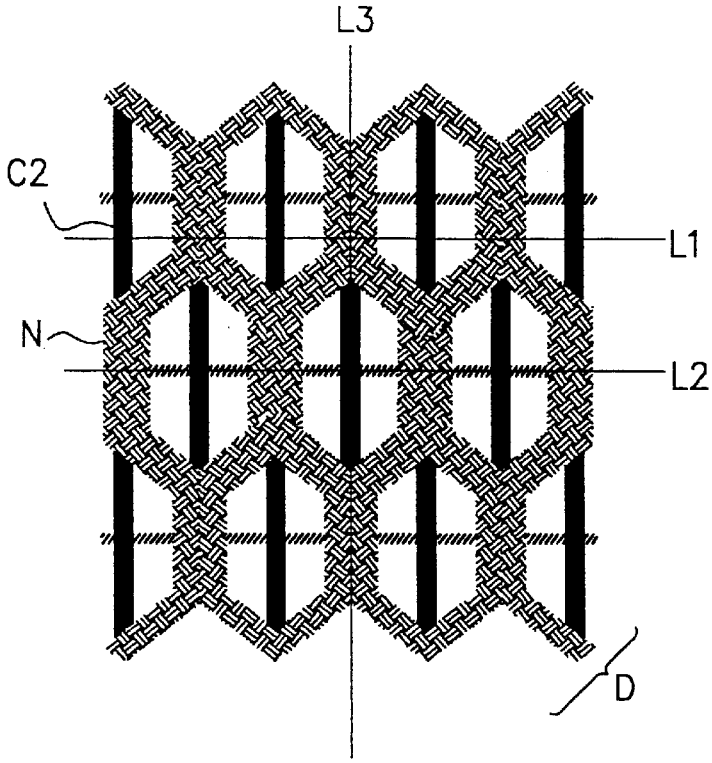
FIG. 5(A) is a top view of a three-dimensionally structured warp knitted fabric according to the second embodiment of the present invention as herein described with a net texture for either of the top and bottom substructures and a plain texture for the other so that the substructure connecting yarn controlling yarns are arranged in rectangular wave form, FIG. 5(B) L1 and L2 are course-wise cross-sectional views of the fabric taken along lines L1 and L2, respectively, in FIG. 5(A)
FIG. 5(C) is a wale-wise cross-sectional view of the fabric taken along line L3 in FIG. 5(A).
Figure 5:
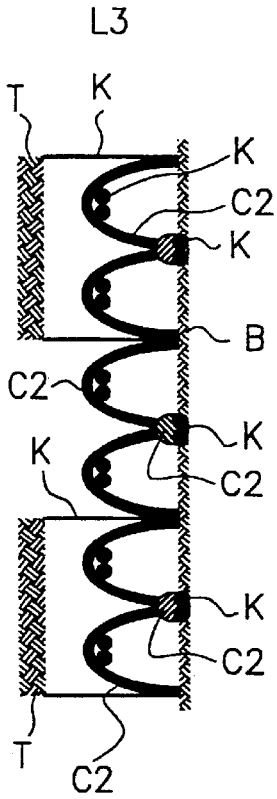
Figure 5:
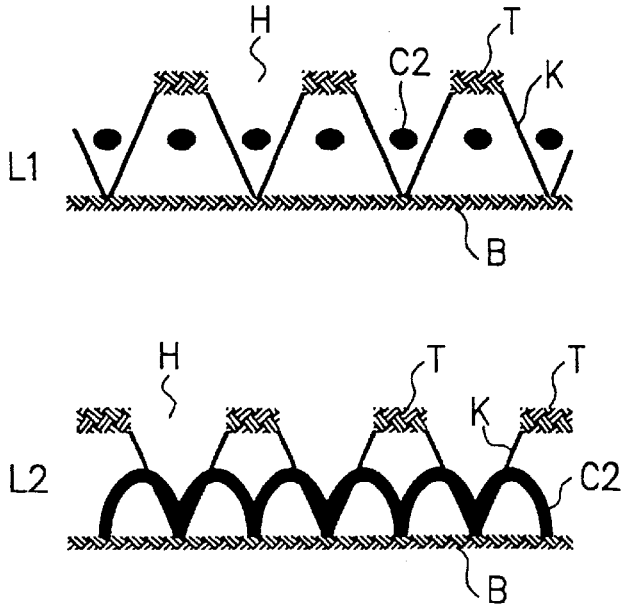

In this embodiment of the present invention, as shown in FIG. 5, the three-dimensionally structured warp knitted fabric (D) is designed in a similar way to its first embodiment as typically shown in FIG. 3 with a net texture for its top substructure (T) and a plain texture for its bottom substructure (B). The net texture has hexagonal pores (H). The three-dimensionally structured warp knitted fabric (D) has yarns connecting the top and bottom substructures at right angles (orthogonally) (K) in its course-wise cross-section as shown in FIG. 5(B). It should be noted here with regard to FIG. 5(B), wherein the substructure orthogonally connecting yarns are apparently oblique, that this apparent obliqueness of the yarns is attributable to the principle underlying the knitting of a net texture, according to which the opening of the pores in the net texture causes them to be inclined at oblique angles, although they are, in principle, arranged perpendicularly in parallel to one another when the net texture is knitted.

Figure 6:
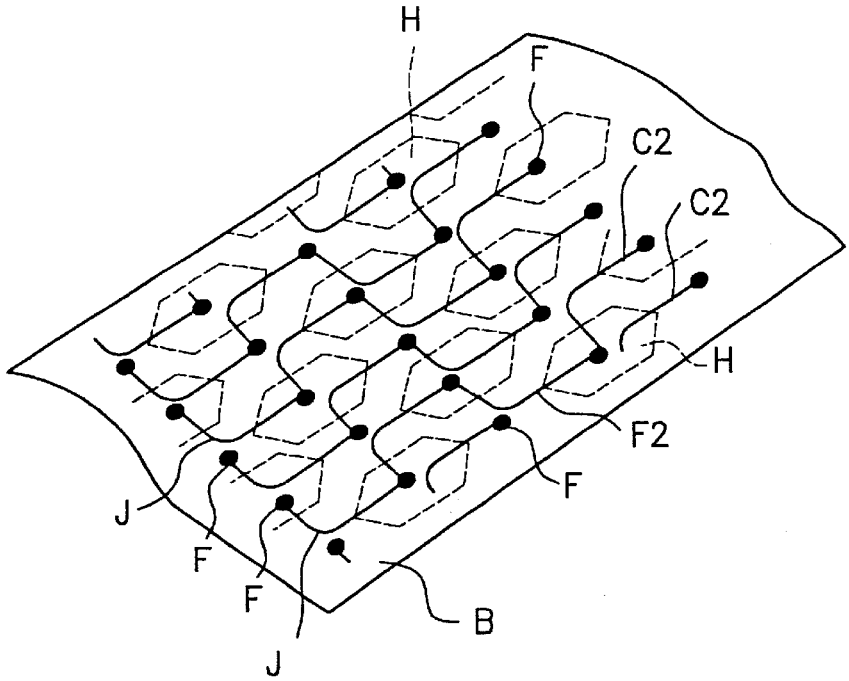
FIG. 6(A) is a fragmentary view of the three-dimensionally structured warp knitted fabric according to the second embodiment of the present invention (as typically depicted in FIG. 5), schematically illustrating how the rectangular-wave-wise arranged substructure connecting yarn controlling yarns are arranged and stitched into the plain texture, while floating between the yarn stitched points.
FIG. 6(B) is a fragmentary view of the same fabric, schematically illustrating how the rectangular-wave-wise arranged substructure connecting yarn controlling yarns separate and handle substructure connecting yarns.
Figure 6:
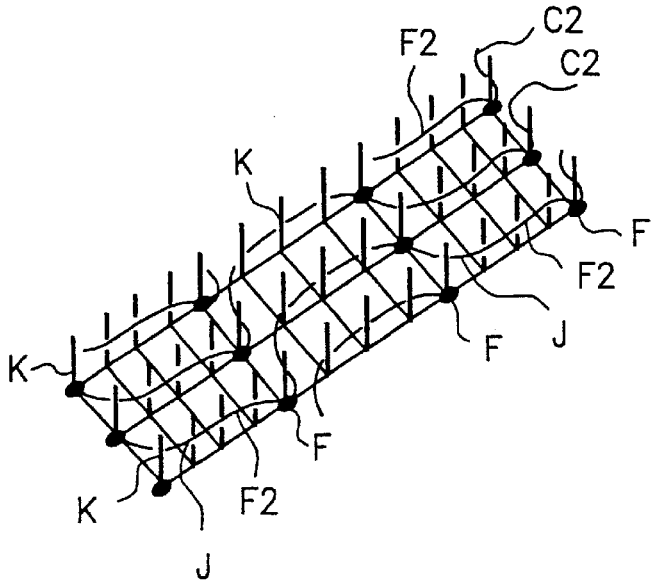

The yarns present between the substructure connecting yarns to control them (C) are designed as substructure connecting yarn controlling yarns arranged in rectangular wave form on the plain texture in the wale-wise direction (C2) as best depicted in FIG. 6(A). The rectangular-wave-wise arranged substructure connecting yarn controlling yarns (C2) comprise points at which they are stitched by knitting into the plain-texture bottom substructure at given intervals in a regular manner (F) and portions connecting between the yarn stitched points where they are floating between the top and bottom substructures (F2). The yarn floating portions (F2) have one curved point (J) between the two yarn stitched points (F) constituting any particular one of them. The curved point (J) is not to be knitted into the bottom substructure. As shown in FIG. 6(A), the rectangular-wave-wise arranged substructure connecting yarn controlling yarns (C2), when observed from each of the pores (H) in the net texture, have the yarn stitched point (F) and curved point (J) so close to each other that they look as if to intersect at these points in a cross-shaped form.

FIG. 5(B) L1 and L2 schematically depict the course-wise cross-sections of the three-dimensionally structured warp knitted fabric according to the present invention (D) along lines L1 and L2 in FIG. 5(A), respectively. As well understood from this figure, the rectangular-wave-wise arranged substructure connecting yarn controlling yarns (C2) are positioned between the substructure orthogonally connecting yarns (K) to separate them positively. FIG. 5(C) schematically illustrates the wale-wise cross-section of the three-dimensionally structured warp knitted fabric of the present invention (D) along line L3 in FIG. 5(A). As can be seen from this figure, the rectangular-wave-wise arranged substructure connecting yarn controlling yarns (C2) hold the substructure orthogonally connecting yarns (K) in the shape of an arch.

In the three-dimensionally structured warp knitted fabric configured as described above according to the present invention, the rectangular-wave-wise arranged substructure connecting yarn controlling yarns (C2), as best depicted in FIG. 6(B), lie between the substructure orthogonally connecting yarns (K) in such a way as to thread between them with curving at certain points, while being stitched into the plain-texture bottom substructure at given intervals, allowing them, if their density is high, to be separated into blocks to efficiently dispose of their entanglement caused when the fabric is subjected to compression. In addition, the presence of the rectangular-wave-wise arranged substructure connecting yarn controlling yarns (C2) in the three-dimensionally structured warp knitted fabric of the present invention, which, as observed from the pores (H) in the net texture of the bottom substructure, have the yarn stitched points (F) and curved points (J) so close to each other that they look as if to intersect at these points in a cross-shaped form, contributes to its enhanced design effects.

(Third Embodiment of the Present Invention)

Figure 7:
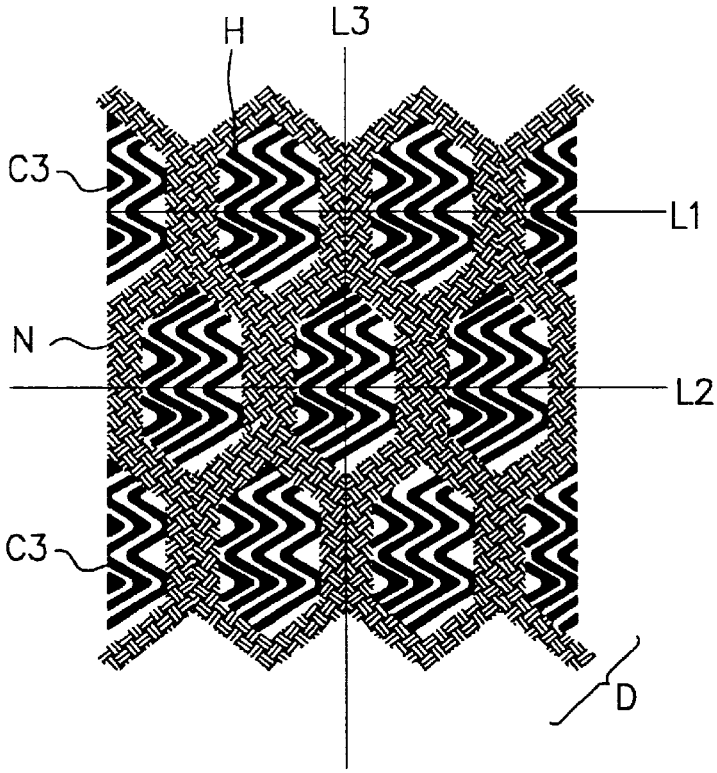
FIG. 7(A) is a top view of a three-dimensionally structured warp knitted fabric according to the third embodiment of the present invention as herein described with a net texture for either of the top and bottom substructures and a plain texture for the other so that the substructure connecting yarn controlling yarns are arranged in zigzags, FIG. 7(B) L1 and L2 are course-wise cross-sectional views of the fabric taken along lines L1 and L2, respectively, in FIG. 7(A)
FIG. 7(C) is a wale-wise cross-sectional view of the fabric taken along line L3 in FIG. 7(A).
Figure 7:
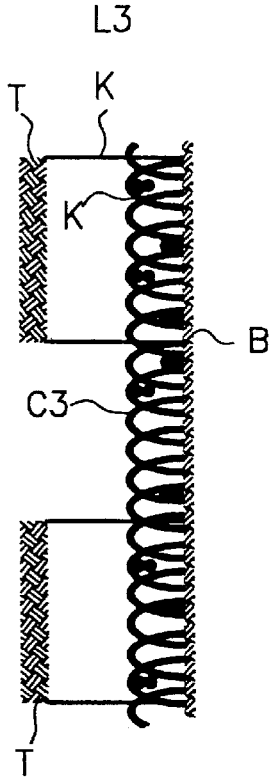
Figure 7:
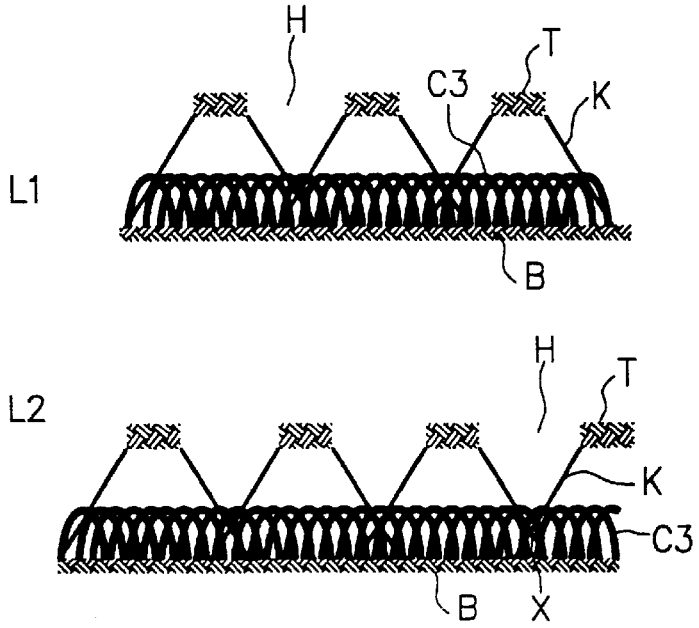

In this embodiment of the present invention, as shown in FIG. 7, the three-dimensionally structured warp knitted fabric (D) is designed in a similar way to its first and second embodiments as typically shown in FIG. 3 and FIG. 5, respectively, with a net texture for its top substructure (T) and a plain texture for its bottom substructure (B). The net texture has hexagonal pores (H). The three-dimensionally structured warp knitted fabric (D) has yarns connecting the top and bottom substructures at oblique angles (K) with X-shaped intersections (X) in its course-wise cross-section as shown in FIG. 7(B).

Figure 8:
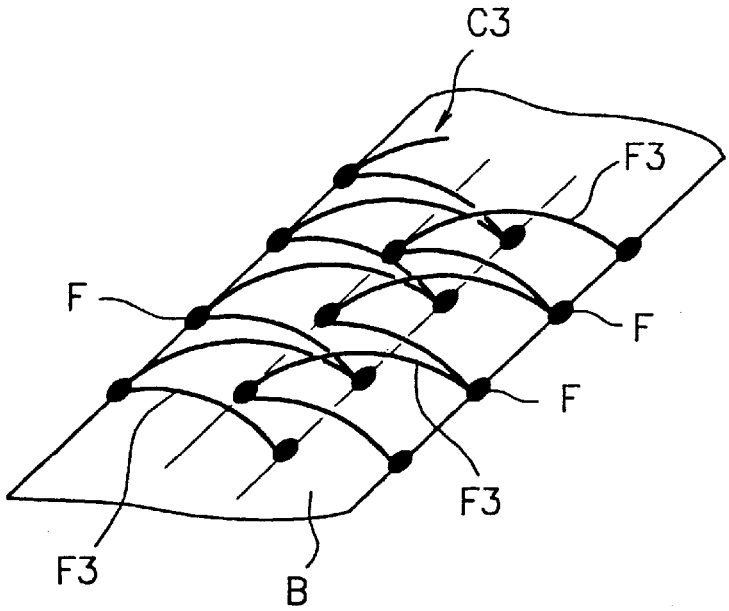
FIG. 8(A) is a fragmentary view of the three-dimensionally structured warp knitted fabric according to the third embodiment of the present invention (as typically depicted in FIG. 7), schematically illustrating how the zigzag arranged substructure connecting yarn controlling yarns are arranged and stitched into the plain texture, while floating between the yarn stitched points.
FIG. 8(B) is a fragmentary view of the same fabric, schematically illustrating how the zigzag arranged substructure connecting yarn controlling yarns hold down substructure connecting yarns.
Figure 8:
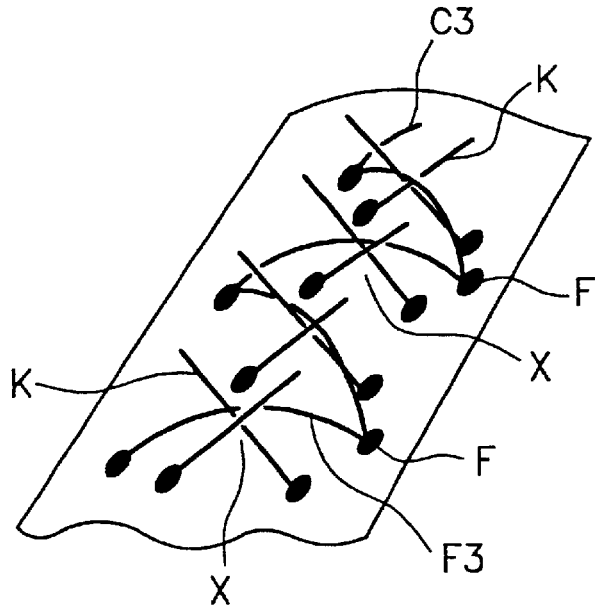

The yarns present between the substructure connecting yarns at their intersections to control them (C) are designed as substructure connecting yarn controlling yarns arranged in zigzags in the wale-wise direction (C3) as best depicted in FIG. 8(A). The zigzag arranged substructure connecting yarn controlling yarns (C3) comprise points at which they are stitched by knitting into the plain-texture bottom substructure (B) at given intervals in a regular manner (F) and portions connecting between the yarn stitched points where they are floating between the top and bottom substructures (F3).

In the three-dimensionally structured warp knitted fabric configured as described above according to the present invention, the substructure obliquely connecting yarns (K), whose intersections (X), as best depicted in FIG. 8(B), are positively held downward by the zigzag arranged substructure connecting yarn controlling yarns (C3), present no problem of protruding from the hexagonal pores (H) and becoming entangled with one another when the fabric is subjected to compression while in use, which may otherwise cause such problems, resulting in deterioration in its resiliency and recovery from the compression.

FIG. 7(B) L1 and L2 schematically depict the course-wise cross-sections of the three-dimensionally structured warp knitted fabric according to the present invention (D) along lines L1 and L2 in FIG. 3(A), respectively. As well understood from this figure, the zigzag arranged substructure connecting yarn controlling yarns (C3) positively hold down the intersections (X) of the substructure obliquely connecting yarns (K), while presenting a pile-like appearance to serve as functional and design effects of the three-dimensionally structured warp knitted fabric according to the present invention. FIG. 7(C) schematically illustrates the wale-wise cross-section of the three-dimensionally structured warp knitted fabric of the present invention (D) along line L3 in FIG. 3(A). As can be seen from this figure, the zigzag arranged substructure connecting yarn controlling yarns (C3) hold the substructure obliquely connecting yarns (K) in the shape of an arch.

Although the present invention has been described herein in detail in relation to its preferred embodiments, it is understood that the present invention is not limited to the three-dimensionally structured warp knitted fabric illustrated in the accompanying drawings, but can be otherwise embodied in various forms and ways within the spirit and scope thereof as defined in the appended claims. The present invention will be understood more clearly by reference to the results of the evaluation made on the three-dimensionally structured warp knitted fabrics manufactured according the following specific examples of the present invention and its conventional counterpart.

EXAMPLE

Based on the three embodiments of the present invention herein illustrated in association with the accompanying drawings, each presenting a specific type of three-dimensionally structured warp knitted fabric (D) that can be manufactured on a double needle bed warp knitting machine (Mayer-made model RD.PLM-22G), a knitting process was carried out on the above-mentioned warp knitting machine to manufacture three (3) types of three-dimensionally structured warp knitted fabrics corresponding to the three respective embodiments so that fabric thickness was 3.0 mm and the pores in the net texture substructure were shaped in the form of a hexagon with its each side comprising six (6) courses. The three fabrics are hereinafter referred to as Warp Knitted Fabric 1 (corresponding to the first embodiment of the present invention), Warp Knitted Fabric 2 (corresponding to the second embodiment of the present invention) and Warp Knitted Fabric 3 (corresponding to the third embodiment of the present invention). In knitting the fabrics, the knitting machine was operated using a total of six guide bars—the first two, as viewed from its front, for the net texture, the third for the substructure connecting yarns, the fourth for the substructure connecting yarn controlling yarns and the fifth and six for the plain texture.

As a comparative example for the present invention, a similar knitting process to that used for the above three fabrics of the present invention except it did not use the substructure connecting yarn controlling yarns of the present invention was carried out to manufacture a conventional (prior art) three-dimensionally structured warp knitted fabric so that the fabric thickness was 3.0 mm and the pores in the net texture substructure were shaped in the form of a hexagon with its each side comprising six (6) courses. This fabric is hereinafter referred to as Warp Knitted Fabric 4. These four fabrics were subjected to two tests—(1) Fuzzing resistance test and (2) Taber's abrasion resistance test. The results of the tests are shown in Table 1.

TABLE 1

The results of the tests

| | Fuzzing resistance test | | | | Taber's abrasion resistance test | Evaluation |
|---|---|---|---|---|---|---|
| | Wale | Course | Forward-bias | Backward-bias | | |
| Warp Knitted Fabric 1 | ○ | Δ | Δ~○ | Δ~○ | ○ | ○ |
| Warp Knitted Fabric 2 | ○ | ○ | ○ | ○ | ○ | ⊙ |
| Warp Knitted Fabric 3 | ○ | ○ | ○ | ○ | ○ | ⊙ |
| Warp Knitted Fabric 4 | X | X | X | X | X | X |

1. Fuzzing resistance test (Magic Tape rubbing resistance) Each of the Warp Knitted Fabrics 1 to 4 was cut to prepare four (4) specimens (each measuring 30 mm in width and 130 mm in length) with their lengthwise dimensions parallel to the wale, course, forward- and backward-bias directions of the fabric, respectively. Each of the specimens was set on a rubbing tester (commercially marketed by Daiei Kagaku Seiki Mfg. Co., Ltd. for intended use in testing fabric for color fastness to rubbing) to rub the specimen against 500 gf loaded Magic Tape by moving the tape five times in each direction to measure it for its fuzzing resistance.
2. Taber's abrasion resistance test Each of the Warp Knitted Fabrics 1 to 4 was cut to prepare a specimen (shaped in the form of a circle with a diameter of 120 mm). The specimen was set on a rotary abraser specified in ASTM D3884 6.1 to abrade it with 50 gf loaded CS#10 abrasion wheel by revolving the wheel 1000 times to measure it for its abrasion resistance.

The results of the measurements were evaluated for both of the tests according to the following four-grade rating system:

⊙: No change on the rubbed or abraded surface compared to its state before the test ○: Fuzzing on the rubbed or abraded surface noted to an appreciable extent Δ: Fuzzing on the rubber or abraded surface and protrusion of the substructure connecting yarns from the pores in the net texture both noted to an appreciable extent X: Fuzzing on the rubber or abraded surface and protrusion of the substructure connecting yarns from the pores in the net texture both noted to a marked extent Table 1 shows that the three-dimensionally structured warp knitted fabrics manufactured according to the present invention are strongly resistant to rubbing or abrasion, causing little or no fuzzing.

Having described the present invention with a certain degree of particularity, it is obviously the intention of the inventors that the present invention is not limited to its preferred embodiments and examples herein given, but allowing all changes and modifications of these embodiments and examples to be made if they do not constitute any departure from the purpose thereof as specified in the accompanying claims. The yarns of the three-dimensionally structured warp knitted fabric according to the present invention, which are defined herein as the substructure connecting yarn controlling yarns, can be changed or modified in their configuration at least to the extent that they function to control the substructure connecting yarns by handling, separating and holding them.

The three-dimensionally structured warp knitted fabric of the present invention is the result of the modification and improvement made to its conventional counterpart principally consisting of three members—top and bottom substructures and yarns connecting the two substructures—by having these three members combined with a new additional member "yarns controlling the substructure connecting yarns by handling, separating and holding them" to minimize their bending and consequent entanglement that may otherwise occur when the fabric is subjected to compression, resulting in deterioration in its resiliency and recovery from the compression.

In addition, the three-dimensionally structured warp knitted fabric according to the present invention can be designed and manufactured with the arrangement of the substructure connecting yarn controlling yarns available in three types as described herein—linearly arranged substructure connecting yarn controlling yarns C1, rectangular-wave-wise arranged substructure connecting yarn controlling yarns C2 and zig-zag arranged substructure connecting yarn controlling yarns C3, which can be selected according to its intended configuration and functionality.

Furthermore, the three-dimensionally structured warp knitted fabric of the present invention is designed with a net texture for either of the two substructures, which allows the substructure connecting yarn controlling yarns to be seen through the pores in the net texture, enabling them to serve as its functional and design effects if their material is properly selected.

What is claimed is:

1. A three-dimensionally structured warp knitted fabric comprising:

a top substructure and a bottom substructure, wherein one of the top and bottom substructures is a net substructure having a net texture and the other of the top and bottom substructures is a plain substructure having a plain texture;

a plurality of substructure connecting yarns connecting said top and bottom substructures; and a plurality of controlling yarns disposed between said top and bottom substructures and positioned between and adjacent said substructure connecting yarns to control said substructure connecting yarns by handling, separating and holding said substructure connecting yarns, each of said plurality of controlling yarns including points at which said controlling yarns are stitched into said plain substructure and including portions floating between said top and bottom substructures to control said substructure connecting yarns.

2. A three-dimensionally structured warp knitted fabric comprising:

a top substructure and a bottom substructure, wherein one of the top and bottom substructures is a net substructure having a net texture and the other of the top and bottom substructures is a plain substructure having a plain texture;

a plurality of substructure connecting yarns connecting said top and bottom substructures, said plurality of substructure connecting yarns having X-shaped intersections when said fabric is viewed along a course-wise cross section; and a plurality of controlling yarns disposed between said top and bottom substructures and positioned between and adjacent said substructure connecting yarns to control said substructure connecting yarns by handling, separating and holding said substructure connecting yarns, said controlling yarns being arranged to hold said X-shaped intersections downwardly toward said bottom substructure.

3. A three-dimensionally structured warp knitted fabric comprising:

a top substructure and a bottom substructure, wherein one of the top and bottom substructures is a net substructure having a net texture and the other of the top and bottom substructures is a plain substructure having a plain texture;

a plurality of substructure connecting yarns connecting said top and bottom substructures, said plurality of substructure connecting yarns being oriented at right angles with respect to both of said top and bottom substructures; and a plurality of controlling yarns disposed between said top and bottom substructures and positioned between and adjacent said substructure connecting yarns to control said substructure connecting yarns by handling, separating and holding said substructure connecting yarns, each of said plurality of controlling yarns including portions which are stitched to said plain texture substructure at intervals and portions which are floating between said top and bottom substructures and wind between said substructure connecting yarns to control said substructure connecting yarns.

4. The three-dimensionally structured warp knitted fabric as claimed in claim 1, wherein said controlling yarns are arranged linearly, and stitched into the plain substructure at intervals in the wale direction.

5. The three-dimensionally structured warp knitted fabric as claimed in claim 1, wherein said controlling yarns are arranged in rectangular wave form, and stitched into the plain substructure at intervals in the wale direction.

6. The three-dimensionally structured warp knitted fabric as claimed in claim 1, wherein said controlling yarns are arranged in zigzags in a yarn zigzag arrangement, and stitched into the plain substructure at intervals with the yarn stitching points as the turn-back of the yarn zigzag arrangement.

* * * * *